United States Patent [19]

McKee

[11] 4,178,592

[45] Dec. 11, 1979

[54] FIRE ALARM HAVING A SENSOR ON AN EXTENSIBLE ARM

[76] Inventor: Maureen K. McKee, 8200 Redlands Ave., Playa Del Rey, Calif. 90291

[21] Appl. No.: 871,384

[22] Filed: Jan. 23, 1978

[51] Int. Cl.[2] ..... G08B 17/06

[52] U.S. Cl. ..... 340/693; 340/586; 340/628; 340/691

[58] Field of Search ..... 340/693, 586, 628, 691

[56] References Cited

U.S. PATENT DOCUMENTS

| | | | |
|---|---|---|---|
| 2,552,331 | 5/1951 | Lamb | 340/691 |
| 3,258,757 | 6/1966 | Burdwood | 340/691 |
| 3,908,180 | 9/1975 | Braginsky | 340/693 |

*Primary Examiner*—Glen R. Swann, III

*Attorney, Agent, or Firm*—Sigalos & Levine

[57] ABSTRACT

A smoke and fire sensitive alarm system designed for portable operation all electronics, power supply and alarm in a single, compact unit which may be placed on any surface. The sensing portion of the alarm circuit is mounted remotely by virtue of a telescopic or folding arm in order to raise the sensing unit well above the floor level so that signs of a fire such as smoke or heat may be easily detected. The telescopic arm is connected to the main unit so that the entire unit may be easily transported.

23 Claims, 8 Drawing Figures

FIRE ALARM HAVING A SENSOR ON AN EXTENSIBLE ARM

BACKGROUND OF THE INVENTION

The present invention relates to apparatus for detecting and indicating the signs of a fire such as smoke or heat so as to provide warning of the probability or possibility of fire.

Known fire detecting systems of the prior art have many disadvantages. They are normally rigidly or fixedly installed in locations where it is desired to monitor the presence of smoke or heat. They are usually dependent upon the building electrical system which may be rendered inoperative itself in the event of a fire. The alarm indicators themselves are usually placed at some distance from the smoke or heat detector itself where it could be difficult for a person having hearing or visual problems to be alerted. Further, they cannot be conveniently tested by the individuals they are designed to protect and warn. In some earlier apartment units where smoke or heat detectors are not located, the apartment dwellers themselves may not be allowed to mount heat or smoke alarms on ceilings due to radiant heating coils in the ceiling. Where prior art systems do exist, they are usually very expensive and link together one system for an entire building.

Further, it is important to be able to detect a fire at different locations in a building depending upon times or seasons. For instance, in the winter when the furnace is running a great amount of time, it is important to be alert for fires in the furnace area. In the summer when the air conditioning units have predominant use, it may be important to check these units for overheating. In the summer, it would be advantageous to locate a heat sensor somewhere other than near a window. In the winter, it would be appropriate to locate a sensor near the fireplace to detect overheating or smoke entering the room.

Also, it is important to be able to locate a fire sensor at different heights in a room. In the summer when the heat rises, it is important to locate a heat sensor somewhere other than near the ceiling. In the winter, the sensor may be more advantageously located near the ceiling. Where there are heating ducts near the floor, it may be desired to locate the sensor near the floor; where the heating ducts are located near the ceiling, it would be appropriate and desirable to locate the sensor near the ceiling. Obviously, "hot spots" or areas susceptible to fire can be located almost anywhere in a building.

Thus, the need is to be able to have an economical yet reliable fire detection system which is portable and yet can have a sensor easily selectively positionable where needed. A sensor can be so positioned if mounted at the outermost end of an extensible rod or column such as an antenna which is both pivotably and rotatably attached at its base to a fixture and which has a maximum and a minimum extended length. The sensor can then be positioned anywhere within a hemisphere of revolution generated by sweeping said extensible antenna through 360′ of rotation about its pivot point while moving from a vertical position to a horizontal position, the maximum radius of said hemisphere of revolution being equal to the fully extended length of the extensible antenna and the minimum radius of said hemisphere of revolution being equal to the shortest collapsed length of the extensible antenna.

SUMMARY OF THE INVENTION

The present invention overcomes the disadvantages of the prior art by providing a fire detecting system which is conveniently portable and has no need for electrical connections and thus is independent of building electrical systems which may fail in the event of a fire. Further, the system is ideal for travelers in that it can be placed in any desired location and adjusted to a height within a hemisphere of revolution having a maximum and a minimum radius to give early warning of the presence of a fire. It is easily installed and the elderly can make the unit functional in a matter of seconds with no ladders to climb or units to adjust. The system is easily tested so that the user will have confidence that the unit is working. Further, it is easily maintained inasmuch as the power supply can be either normal alternating current or a unit with batteries which can be changed conveniently. Further, in a residence where dwellers may not be allowed to mount heat or smoke alarms on the ceilings due to radiant heating coils in the ceiling, the instant invention may be used with confidence and ease by positioning the sensor in any desired location. Also, it may be used by persons not wishing to invest in an expensive, permanent type installation.

The fire detector comprises a sensor for producing an electrical signal when detecting signs of a fire such as heat and/or smoke, alarm circuitry coupled to the sensor for producing an alarm signal when said electrical signal is received from the sensor, an alarm coupled to the alarm circuitry for producing a detectable signal such as a visual, physical or audible alarm when activated by the alarm signal, a power supply coupled to the sensor, alarm circuitry and the alarm itself for providing operating power thereto, housing means for containing the alarm circuitry, alarm means and power supply and extensible means such as an antenna attached to the housing means for receiving the sensor at its outermost end and being capable of locating the sensor in any desired position within a hemisphere of revolution having a maximum and a minimum radius to detect smoke or heat.

Variations of this invention include battery powered operation for enhanced portability, incorporation of the sensing unit with an alarm clock or clock-radio wherein the power supply for the alarm clock or clock-radio can be used for the sensor, the alarm circuitry and the alarm indicator and incorporation of the heat and/or smoke detecting unit with a portable radio wherein the radio power supply, extensible antenna and speaker may be used as parts of the smoke or heat detecting system.

With existing devices which produce audible or visual indications such as radios, television or lamps, such existing device may be pre-tuned to a station or turned to the "on" position and then plugged into a receptable of the detector which will provide power to the radio, television set or the lamp to activate it whenever smoke or heat is detected.

Accordingly, it is an object of the present invention to provide a fire detecting system which may be battery powered for enhanced portability.

Another object of the present invention is to incorporate the heat and/or smoke detecting units with an alarm clock wherein the same power supply and audible alarm indicator will be common to both the clock and the fire detecting system.

It is yet another object of the present invention to provide a portable fire detecting system in which the system is incorporated with a radio wherein the same power supply and boom antenna of the radio are utilized by both the fire detecting system and the radio.

It is still another object of the present invention to provide a fire detecting system in which the system is incorporated with a radio and the same power supply, extensible antenna and audible alarm are common to both the system and the radio.

It is yet another object of the present invention to provide a fire detecting system which is conveniently portable and thereby independent of building electrical systems which may fail in the event of a fire.

Still another object of the present invention is to provide a fire detecting system that is low cost and whose sensor is easily positioned in the desired location within a given hemisphere of revolution, even by the elderly, easily tested and easily maintained and which may be used by those who may not be allowed to mount heat or smoke detecting systems on ceilings due to radiant heating coils in the ceiling.

Another object of the present invention is to provide a smoke or heat detecting system that is economical and yet effective.

BRIEF DESCRIPTION OF THE DRAWINGS

These and other objects of the instant invention may be had by referring to the following specification and drawings in which like numerals indicate like components and in which.

DESCRIPTION OF THE PREFERRED EMBODIMENT

With reference to the Figures, wherein like numerals denote like components throughout, unitary housing 10 encompasses all of the components of the novel fire detector.

Figure 1:
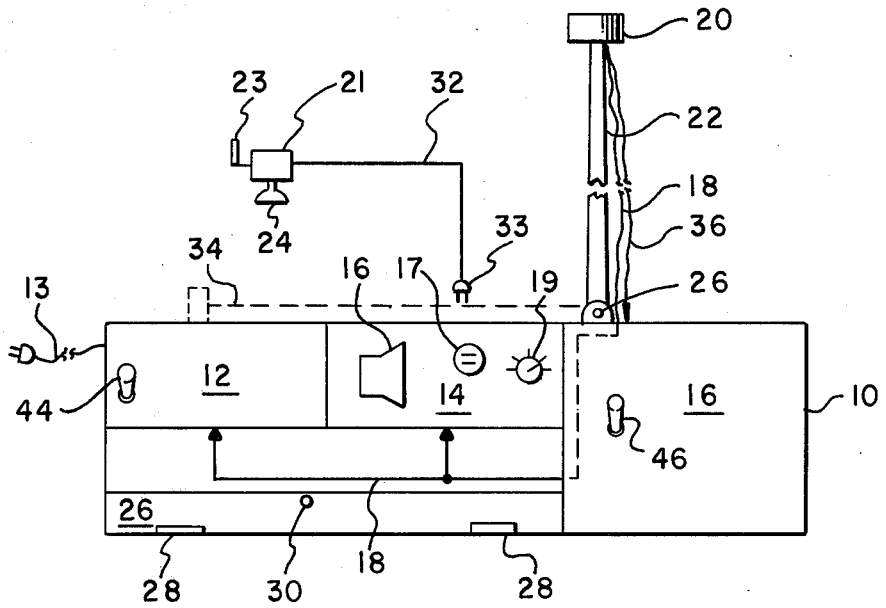
FIG. 1 is a diagrammatic view of the self-contained heat and/or smoke detector of the present invention.

In FIG. 1, housing 10 includes power supply 12, alarm 14 and alarm circuitry 16. Power from power supply 12 is coupled via conductor 18 to alarm 14, alarm circuitry 16 and smoke or heat sensor 20 which is mounted atop extensible (which could be telescopic, if desired) boom or antenna 22 which is pivotally and rotatably attached at point 26 to housing 10. Alarm 14 may be any or all of an audible alarm 16, a visible alarm such as a light 19 or a physical alarm caused by a vibrating device such as motor 21 having attached to the shaft thereof an eccentric weight 23 and to the base thereof a suction cup 24 or other fastening means by which the motor 21 may be attached to an object such as a chair or a bed frame whereby individuals who have problems with sight or hearing may be warned by the physical vibration from motor 21.

Also, alarm 14 may include an electrical output receptacle 17 which would be energized upon alarm 14 being activated by a signal from sensor 20. By plugging a radio, television set, electrical lamp or other device such as vibrating motor 21 which produces audible, visual or physical indications, respectively, into power receptacle 17, such device, if pre-tuned to a station or, in case of the lamp, turned "on," will be energized in the event sensor 20 detects smoke or heat and sends a signal to alarm circuitry 16 which energizes receptacle 17 in a well-known manner. Thus, the radio, television set, lamp or vibrator would be energized to provide a visual, audible or physical warning.

If desired, housing 10 could include a compartment having a door 26 pivoted about hinges 28 and havng handle 30 whereby the door may be opened and the interior of the compartment exposed. In this compartment may be kept motor 21 and its associated conductor 32 and male plug 33. The same compartment may also contain the batteries represented by power supply 12 if it is desired for the unit to be portable or a detachable power cord 13 if it is desired to have a unit which operates from a common commercial electrical circuit.

The operation of the heat and/or smoke sensor 20 is well known in the art and need not be discussed in detail herein. Smoke sensor 20 detects signs of a fire such as smoke or heat and may, for example, be of the photoelectric, ionizing or heat sensitive type, all of which are known in the prior art. A photoelectric type, for example, is disclosed in U.S. Pat. No. 2,468,740.

The ionizing type has a flow of ions between an emitter and a receiver which, if interrupted by smoke particles, causes an alarm signal to be generated and sent to the alarm circuitry. The heat sensing type has bimetallic contacts which close at a predetermined temperature such as 135° Fahrenheit and cause an alarm signal to be generated. These detectors or sensors are conveniently available from any electronic equipment supplier.

Sensor 20 is mounted on the end of a collapsible or extensible telescopic type boom 22 which may either be in its vertical extended position as shown, in its horizontal position or in its collapsed position for storage as shown by dashed lines 34 in FIG. 1. Sensor 20 can easily be positioned by anyone, including the elderly, in any desired position within a hemisphere of revolution to detect the presence of heat and/or smoke. Upon detecting the presence of smoke or heat, sensor 20 generates an electrical signal through conductor 36 to alarm circuitry 16. Alarm circuitry 16, which may, for example, be an oscillator or a relay circuit such as shown in U.S.

Pat. No. 2,468,740, energizes alarm 14. As stated earlier, alarm 14 may include an audible alarm such as buzzer 16, an electrical receptacle 17 for energizing electrical devices producing visual, audible or physical indications, a visual alarm such as light 19 or a physical alarm which may be sensed through vibrations created by a motor 21 having eccentric weights attached to the motor shaft thereof and with motor 21 being coupled to receptacle 17 by male plug 33 and being mounted on a device which will carry the vibrations to the user thereof. Any of these alarms may be activated by a circuit of a type similar to that disclosed in the aforementioned patent.

Figure 2A:
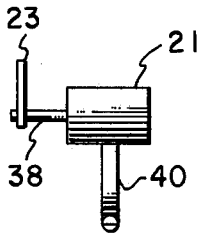
FIG. 2A is a side view of a small motor having an eccentric weight attached to the shaft thereof and a clamp device for attaching the motor to a physical object according to one embodiment of this invention.
Figure 2B:
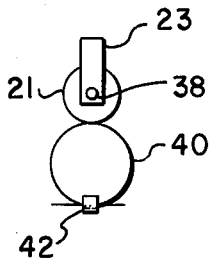
FIG. 2B is a front view of said motor with said eccentric weight and said clamp means.

FIG. 2A is a side view of motor 21 showing eccentric weight 23 attached to rotor shaft 38 and having an alternate means 40 of attaching the motor 21 to a fixture which would transmit the vibrations thereof to the user. Alternate fastening means 40 may be a clamp which can be manually adjusted to tighten about an object and thus hold motor 21 fixedly attached thereto. FIG. 2B is a front view of motor 21 again showing eccentric weight 23 attached to rotor shaft 38 and showing clamp 40 attached to said motor and having a thumb-tightening screw 42 which can be manually tightened easily by the user to fasten motor 21 to a desired object.

Figure 5:
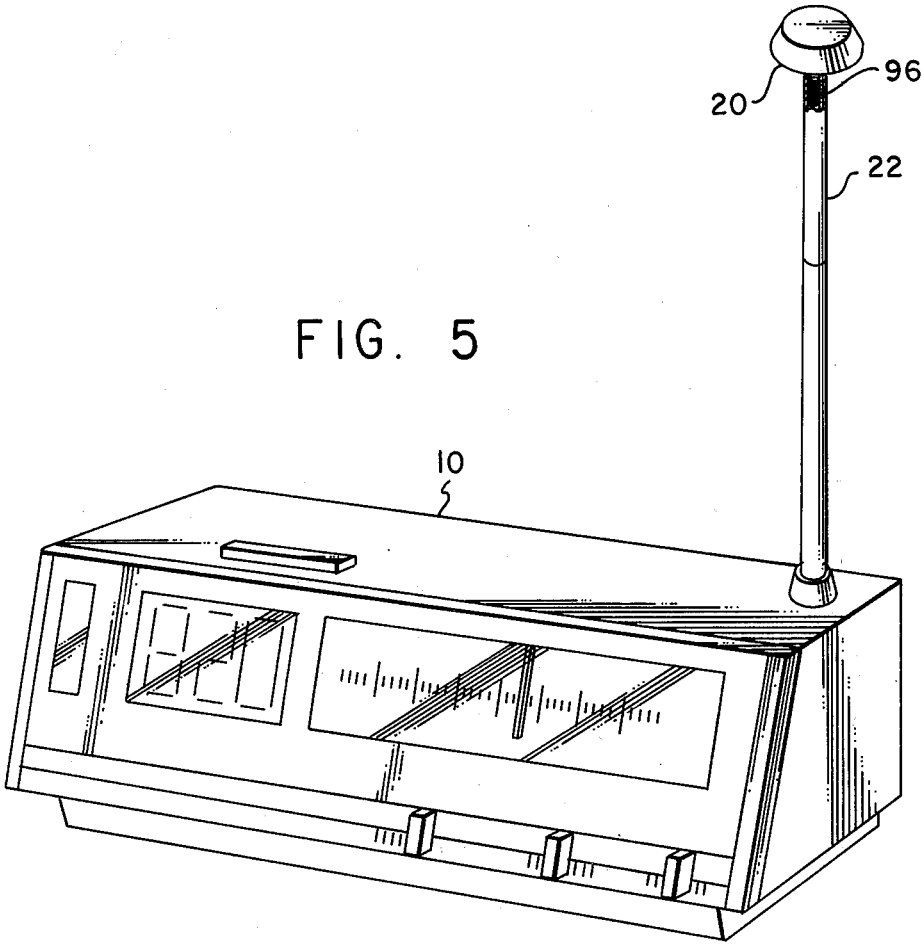
FIG. 5 is a perspective view of an embodiment of this invention used in conjunction with a clock-radio.

While sensor conductors 18 and 36 are shown located externally to antenna 22, the conductors can also be located within the hollow interior of antenna 22 by using resilient, coiled conductors 96 (see FIG. 5) which stretch when antenna 22 is extended and return to their coiled shape when the antenna is collapsed as shown in FIGS. 1 or 5.

Thus, it can be seen that the novel fire detector is or may be conveniently portable with no need for electrical connections and obviously would be used as a portable where no wall outlet is present. This means that the system may be independent of a building electrical system which could fail in the event of a fire. Further, because of its portability, compactness and light weight, the unit is ideal for travelers inasmuch as it can be conveniently placed on any night stand with the sensor adjusted to the desired height and would then give early warning of any fire which can be detected by the presence of smoke or heat. The only adjustment which the user would have to make would be to raise antenna boom 22 from its collapsed position 34 to an extended position with the sensor placed at any desired height within the hemisphere of revolution as determined by the minimum and maximum height of the antenna. By throwing the battery off-on toggle switch 44 to the "on" position, the unit ready to use. A test toggle switch 46 can also be incorporated in the alarm circuitry to provide a signal to the alarm circuitry simulating a signal received from the sensor thus verifying proper functioning of the system. Further, if desired, motor 21 could be taken from the compartment through door 26 and attached to the bed frame or other object through which the user could sense vibrations in the event of a fire. The motor 21 itself may have a male electrical plug 33 for inserting into receptacle 17. Such a unit is easily maintained since the batteries may be changed by replacing them in housing 10. Further, the device can be used in any location whether at home or traveling.

The unit as thus far described is a module suitable for connection to existing appliances such as alarm clocks, radios, etc. It can thus serve the retrofit market.

Another useful variation for the retrofit module aspect of this invention is to plug the alarm clock or other appliance into the sensor module power receptacle 17 and connect the sensor module to a source of power (e.g., normal alternating current). The sensor module in the activated state will close the circuit between the power source and the receptacle 17 thus providing power to the appliance causing it to produce the desired alarm.

Figure 3:
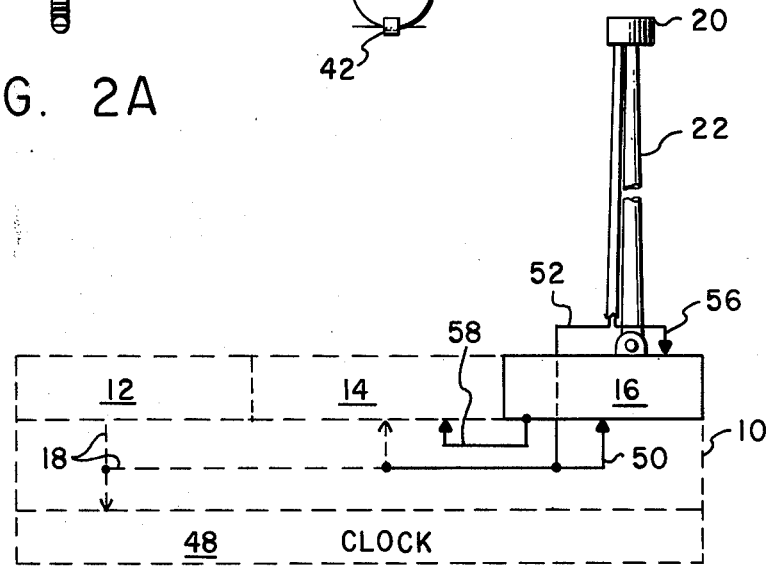
FIG. 3 is a diagrammatic view showing how the instant invention is incorporated with a clock wherein the power supply and alarm of the clock are also used as components of the fire detector according to another embodiment of this invention.

The device becomes even more economical and more readily available to the public by incorporating it in an OEM mode (i.e., Original Equipment Manufacture) with alarm clocks, radios and other appliances (e.g., television sets). FIG. 3 is a diagrammatic representation incorporating the novel heat and/or smoke sensor with a clock, usually a digital type. Housing 10 of the clock has incorporated therein a power supply 12, an alarm 14 and clock circuitry 48. Alarm 14 may be of the type which provides an audible indication. Power supply 12 may be either a battery or power supplied from a conventional A/C power source through a wall receptacle. Power therefrom is coupled through conductor 18 to the alarm 14 and clock circuitry 48. Alarm circuitry 16 and extensible boom 22 with sensor 20 mounted thereon is added to the existing OEM clock to complete integrating this invention with the clock. Power is then coupled from the power source 12 through conductors 50 and 52 to the alarm circuitry 16 and sensor 20, respectively. The output of the sensor 20 is coupled through conductor 56 to the alarm circuitry 16 which, upon receiving a signal from sensor 20, produces an output on conductor 58 which activates alarm 14 to produce a signal whether it be audible, physical or visual. This simple and low cost modification of the OEM clock (which is useful for other appliances as well) provides a uniquely advantageous arrangement suitable for large-scale mass production and distribution. Not only is the unit much more convenient to use and economical to make but it also provides a simple warning system which can be used in the home to provide a warning in case of fire. Components which would normally exist within the housing 10 of the clock are shown in dashed lines while those which have to be added according to this invention are shown in solid lines.

Figure 4:
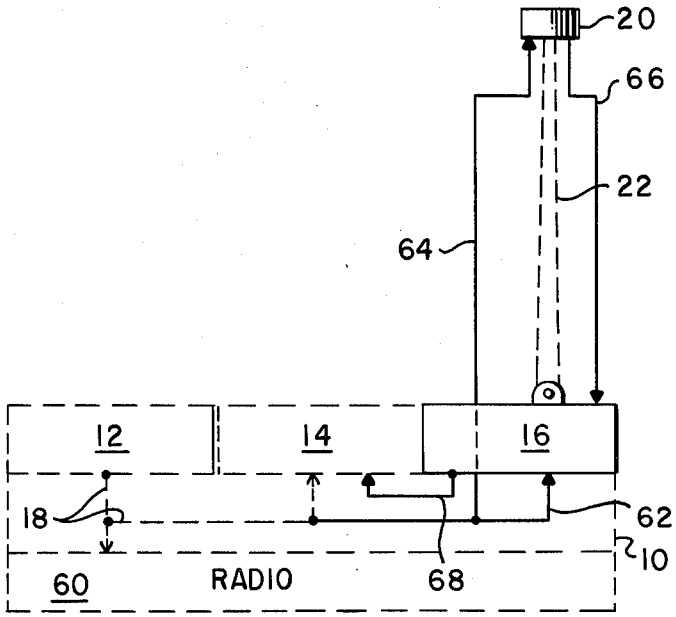
FIG. 4 is a diagrammatic view of a radio wherein the radio power supply, alarm and antenna are used as components of the novel smoke or heat detecting system, according to yet another embodiment of this invention.

FIG. 4 is a diagrammatic representation of the novel fire detecting system incorporated with a radio. (A radio-clock could also be used.) Significant advantages are obtained by incorporating the system with a radio because the radio already has incorporated therein a power supply, an alarm and an extensible antenna or boom. Thus, one merely needs to add the alarm circuitry and the sensor and couple them to the existing alarm, power supply and antenna thus eliminating added cost for these items. In FIGS. 4 and 5, housing 10 of the radio/clock incorporates power supply 12, alarm 14 and radio circuitry 60 all of which receive power from power supply 12 through conductor 18. Alarm 14 can be the speaker of the radio or special audible alarm in the event of an alarm-clock radio such as a buzzer. Also attached to the housing 10 of the radio is an extensible telescopic boom or antenna 22. To incorporate the novel fire detecting system into this appliance, one needs to mount the sensor 20 atop antenna 22 and add within housing 10 alarm circuitry 16. By coupling the power supply 12 to alarm circuit 16 through conductor 62 and sensor 20 through conductor 64, these units are made operational. Now simply connect the output of sensor 20 through conductor 66 to alarm circuit 16 and connect the output of alarm circuit 16 to alarm 14 through conductor 68. Under these conditions, the novel fire and smoke detecting system is made available to the public at an added cost of just the alarm circuit, the sensor and their associated wiring. These costs are minimal when associated with the manufacture of the original equipment.

Figure 6:
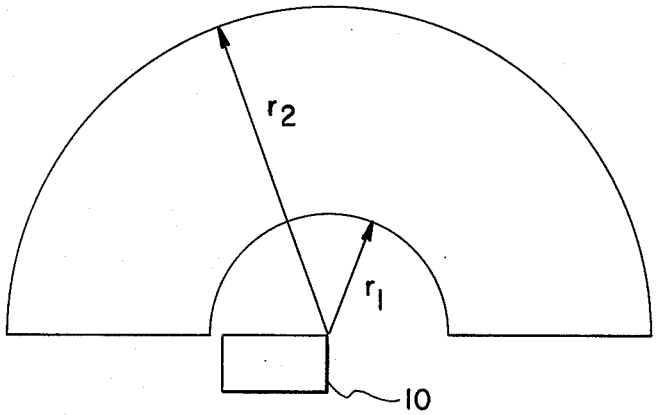
FIG. 6 is an illustration of the zone in which the sensor can be located as determined by the minimum, $r_1$, and maximum, $r_2$, lengths of an extensible rod on which the sensor is mounted.

FIG. 6 is an illustration of the zone in which the sensor can be located as determined by the minimum, $r_1$, and maximum, $r_2$, lengths of an extensible rod on which the sensor is mounted. Assuming that the extensible rod, such as an antenna is both pivotally and rotatably mounted at its base to fixture, chassis or housing 10, and further assuming the antenna to be in its collapsed position of minimum length, $r_1$, it can be seen that as the antenna is pivoted from a vertical to a horizontal position, a semicircle having a radius, $r_1$, is generated. Likewise, if the antenna is extended to its full length, $r_2$, and then pivoted from a vertical to a horizontal position, a semicircle having radius, $r_2$, is generated. If the sensor is mounted at the outermost end of the antenna, the sensor could be positioned anywhere in the area between the two generated semicircles of radius $r_1$ and $r_2$.

Figure 7:
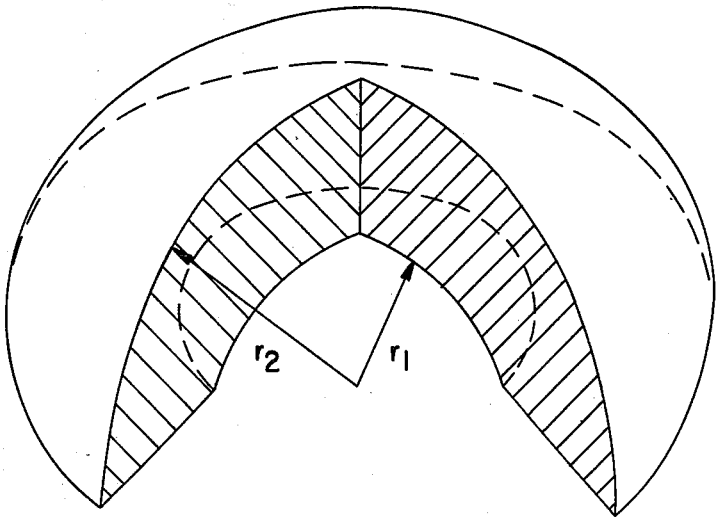
FIG. 7 is a three-dimensional illustration of the hemisphere of revolution generated by sweeping the extensible rod on which the sensor is mounted through 360° of rotation about a pivot point at its base while moving from a vertical to a horizontal position, the maximum radius, $r_2$, of said hemisphere of revolution being equal to the fully extended length of said extensible rod and the minimum radius, $r_1$, being equal to the shortest, collapsed length of said extensible rod.

Now if the antenna is rotated 360° about its pivot point while moving from a vertical to a horizontal position, a hemisphere of revolution is generated as shown in FIG. 7 wherein the maximum radius of the hemisphere is equal to the fully extended length, $r_2$, of said extensible antenna and the minimum radius is equal to the collapsed position or minimum length, $r_1$, of said extensible antenna. This means that if the sensor is mounted at the outermost end of the extensible means, it can be positioned to detect heat or smoke anywhere in the hemisphere of revolution between the minimum and maximum radii of the hemisphere.

Thus, not only is the novel sensor economical to manufacture, but also has features desirable by the user, especially the elderly and those who have visual or hearing problems. The unit is portable so that these individuals can take it with them when they travel; it does not have to have electrical connections with building power, although it can; it can be placed near the bed to give early and efficient warning of fires; it can be easily set up and does not require any ladders or wires to connect in order to use it; it is easily tested by the user to ascertain that the unit is functioning properly, it is easily maintained inasmuch as batteries may be changed directly in the housing and not at some remote location and the sensor is easily positioned in any desired location within a hemisphere of revolution having minimum and maximum radii.

It is understood that suitable modifications may be made in the structure as described and disclosed as come within the spirit and scope of the appended claims.

Having now, therefore, fully illustrated and described my invention, what I claim to be new and desire to protect by Letters Patent is:

1. A portable fire detector comprising:

(a) a sensor for producing an electrical signal when detecting signs of a fire, (b) alarm circuitry coupled to said sensor for producing an alarm signal when said electrical signal is received from said sensor, (c) alarm means coupled to said alarm circuitry for producing a detectable warning signal when activated by said alarm signal, (d) a power supply coupled to said sensor, alarm circuitry and alarm means for providing operating power thereto, (e) housing means for containing said alarm circuitry, alarm means and power supply, and (f) extensible means pivotally and rotatably attached to said housing means for receiving said sensor at the outermost end thereof whereby said sensor may be positioned anywhere within a hemisphere of revolution generated by sweeping said extensible means through 360° of rotation about its pivot point while moving from a vertical position to a horizontal position, the maximum radius of said hemisphere of revolution being equal to the fully extended length of said extensible means and the minimum radius of said hemisphere being equal to the shortest collapsed length of said extensible means.

2. A detector as in claim 1 wherein said detectable warning signal produced by said alarm means is visual.

3. A detector as in claim 1 wherein said detectable warning signal produced by said alarm means is audible.

4. A fire detector as in claim 1 wherein said sensor is a smoke sensor which produces said electrical signal when smoke particles are present.

5. A fire detector as in claim 1 wherein said sensor is a heat sensor having contacts which close to produce said electrical signal when a predetermined temperature is reached.

6. A fire detector as in claim 1 wherein said alarm means for producing said detectable warning signal comprises means for producing vibrations which can be detected by touch.

7. A fire detector as in claim 6 wherein said vibration producing means comprises:

(a) an electric motor having an eccentric weight attached thereto whereby vibrations will be produced by said weight when said motor is energized, and (b) means for attaching said motor to an object for transmitting said vibrations to said object.

8. In a portable fire detector in combination with a radio having an extensible antenna and a power source, the improvement comprising:

(a) a sensor mounted adjacent the outermost end of said extensible antenna and being capable of being extended in a direction away from said radio, said sensor producing an electrical signal upon detecting the presence of a fire, (b) alarm circuitry means coupled to said sensor for producing an alarm signal when said electrical signal is received from said sensor, (c) alarm means coupled to said circuitry means for producing a warning indication when said alarm signal is received, and (d) means coupling said sensor, said circuitry means and said alarm means to said power source for receiving operational power therefrom.

9. A fire detector as in claim 8 wherein said extensible antenna is both rotatably and pivotally attached to said radio whereby said sensor may be positioned anywhere within a hemisphere of revolution generated by sweeping said antenna through 360° of rotation about its pivot point while moving from a vertical position to a horizontal position, the maximum radius of said hemisphere of revolution being equal to the fully extended length of said antenna and the minimum radius being equal to the shortest, collapsed length of said antenna.

10. A fire detector as in claim 8 wherein said sensor is a smoke sensor which produces said electrical signal when smoke particles are detected.

11. A fire detector as in claim 8 wherein said sensor is a heat sensor having electrical contacts which actuate to produce said electrical signal when a predetermined temperature is reached.

12. A detector as in claim 8 wherein said warning indication produced by said alarm means is visual.

13. A detector as in claim 8 wherein said warning indication produced by said alarm means is audible.

14. A fire detector as in claim 8 wherein said alarm means comprises means for producing vibrations which can be detected by touch.

15. A fire detector as in claim 14 wherein said vibration producing means comprises:

(a) an electric motor having an eccentric weight attached thereto whereby vibrations will be produced by said weight when said motor is energized, and (b) means for attaching said motor to an object for transmitting said vibrations to said object.

16. In a portable fire detector in combination with an alarm clock of the type having a power supply and an audible alarm, the improvement comprising:

(a) a sensor for producing an electrical signal when detecting signs indicating a fire, (b) alarm circuitry coupled to said sensor for producing an alarm signal when said electrical signal is received from said sensor, (c) extensible means attached to said alarm clock for receiving said sensor at its outermost end and being capable of locating said sensor in any position in a predetermined hemisphere of revolution to detect signs of a fire, (d) means coupling said alarm circuitry to the audible alarm of said clock whereby an audible signal is produced when said alarm signal is received; and (e) means coupling said sensor, alarm circuitry and audible alarm to said power supply for receiving operating power therefrom.

17. A fire detector in claim 16 wherein said sensor is a smoke sensor which produces said electrical signal when smoke particles are detected.

18. A fire detector as in claim 16 wherein said sensor is a heat sensor which produces said electrical signal when a predetermined temperature is reached.

19. A fire detector as in claim 16 wherein said extensible means is both rotatably and pivotally attached to said clock whereby said hemisphere of revolution is generated by sweeping said extensible means through 360° of rotation about its pivot point while moving from a vertical position to a horizontal position, the maximum radius of said hemisphere of revolution being equal to the fully extended length of said extendible means and the minimum radius of said hemisphere being equal to the shortest, collapsed length of said extensible means.

20. In a portable fire detector in combination with a radio of the type having an extensible antenna, a power source and means for producing an audible alarm, the improvement comprising:

(a) a sensor mounted on the outermost end of said extensible antenna and being capable of being extended away from said radio, said sensor producing an electrical signal when detecting signs indicating a fire, (b) alarm circuitry coupled to said sensor and said audible alarm means for producing an alarm signal when said electrical signal is received from said sensor whereby said audible alarm is activated by said alarm signal, and (c) means coupling said power source to said sensor and said alarm circuitry for supplying operating power thereto.

21. A fire detector as in claim 20 wherein said sensor is a smoke sensor which produces said electrical signal when detecting smoke particles.

22. A fire detector as in claim 20 wherein said sensor is a heat detector which produces said electrical signal when detecting a predetermined temperature.

23. A fire detector as in claim 20 wherein said extensible antenna is both rotatably and pivotally attached to said radio whereby said sensor may be positioned anywhere within a hemisphere of revolution generated by sweeping said extensible means through 360° of rotation about its pivot point while moving from a vertical position to a horizontal position, the maximum radius of said hemisphere of revolution being equal to the fully extended length of said extensible means and the minimum radius being the shortest, collapsed length of said extensible means.

* * * * *